US007857706B2

(12) United States Patent
Novosel, Sr.

(10) Patent No.: US 7,857,706 B2
(45) Date of Patent: Dec. 28, 2010

(54) PERIPHERAL TARGET STAND TRAINING SYSTEM

(76) Inventor: John Michael Novosel, Sr., 12708 Pembroke La., Leawood, KS (US) 66209

( * ) Notice: Subject to any disclaimer, the term of this patent is extended or adjusted under 35 U.S.C. 154(b) by 126 days.

(21) Appl. No.: 12/220,616

(22) Filed: Jul. 25, 2008

(65) Prior Publication Data

US 2009/0048034 A1 Feb. 19, 2009

Related U.S. Application Data

(60) Provisional application No. 60/964,495, filed on Aug. 13, 2007.

(51) Int. Cl.
*A63B 69/36* (2006.01)

(52) U.S. Cl. ..... 473/242; 473/238; 473/257; 473/409

(58) Field of Classification Search ..... 473/226, 473/235, 280, 409, 238, 242, 257
See application file for complete search history.

(56) References Cited

U.S. PATENT DOCUMENTS 3,401,941 A * 9/1968 Hesidence ..... 473/235
3,721,447 A * 3/1973 Louderback ..... 473/235
3,870,316 A * 3/1975 DeBrocke ..... 473/235
3,999,765 A 12/1976 Bishop
4,779,796 A 10/1988 Lai
5,702,309 A * 12/1997 Lee ..... 473/235
6,881,068 B2 4/2005 Thornley
2007/0042830 A1 * 2/2007 Zimmerman ..... 473/235

* cited by examiner

*Primary Examiner*—Nini Legesse
(74) *Attorney, Agent, or Firm*—Robert Hunter

(57) ABSTRACT

A system of training a golf swing including the steps of providing a positional apparatus that provides the golfer with variable impact heights and variable rotational positions to enable them to learn the correct swing, and also includes various additional training items. The stand provides heights ranging from the traditional on the ground striking position up to the golfer's waist to train the swing incrementally and can be positioned anywhere within the golfer's peripheral sight. It also provides the golfer a way to learn the correct movements used in the swing without the pressure of trying to effect a golf ball flight.

20 Claims, 9 Drawing Sheets

PERIPHERAL TARGET STAND TRAINING SYSTEM

I claim the benefit of provisional Application No. 60/964,495 filed Aug. 13. 2007.

BACKGROUND

1. Field of the Invention

This invention relates to sports training aids, specifically to a golf swing training aid. Moreover, this invention relates to a device that indicates to the golfer exactly how to get rid of the casting and coming over the top move that plague most of today's and yesterday's golfers.

2. Description

Throughout the years there have been many golf inventions that attempted to vary the height of the striking surface in relation to the golfer. The purpose of most of them is to enable the golfer to practice uphill, downhill or sidehill lies or to be able to use a shortened club so that they might practice inside. Examples of these are Lai #4779796, Thornley #6881068, and Bishop #3999765. Unfortunately they all use clubs and balls, which limits the flexibility of the drills and positions needed for the golfer to learn a correct swing. And because they all have the golfer address the ball in the same conventional manner, they don't provide help to stop what is commonly called "casting," the cause of all poor golf shots. It is therefore desirable to provide an improved device and method to enable golfers to actually make a swing that does not involve this casting motion. It is also desirable to have this device have the property of being safe to use for the average golfer.

OBJECTS OF THE INVENTION

Therefore the principal object of the present invention is to provide an improved method and apparatus for giving unmistakable positive and at the same time incremental feedback to the user for training the movements of the body to properly execute a golf swing by giving the golfer a means whereby they might learn the correct movements of a golf swing from a standing up straight, rather than a bent over position. Another object of the present invention is to provide a method and apparatus which enables the golfer to have the object that is to be struck positioned forwardly of the golfer and on the correct swing path. Another object of the invention is to have the object that is to be struck positioned off the ground approximately a foot or so that the golfer might learn the correct action of the club as to how it is swung from the inside path in a golfing stroke.

The golf swing is a complicated movement that is best accomplished by the interaction of alternating contraction and relaxation of opposing muscle groups. Because this movement occurs in less than two seconds and must be coordinated to the millisecond, it cannot be controlled by conscious thought. It must be trained through the subconscious mind. Thus while in training, it is desirable that the golfer have the correct picture of how the club is swung in a golfing stroke, so that he can keep mental interference to a minimum.

This invention conveys this information to the golfer by making it possible to adjustably mount a movable, lightweight target to the top of the apparatus. This makes it possible to learn the correct movement of the body while standing in an upright position, thus eliminating one of the most frustrating things about learning the golf swing, that of bending over and trying to accomplish all the required movements when the spine is angled at a forty five degree plane. It also provides the golfer with feedback on the correct holistic movement of the body in relation to the golf club throughout the entire stroke in an incrementally adjustable manner.

In addition, this device corrects the "casting" motion which is the most common fault of the ordinary golfer. Once the club is cocked in the backswing, the most common mechanical fault among golfers is the premature releasing of the power angle between the radial surface of the leading arm and the club. Professional golfers are said to retain this power angle through their swings longer than less accomplished amateur golfers, and therefore, consistently obtain more accuracy and distance in their golf shots.

The device allows a golfer to position the target at a forty five degree angle from where a golf ball would be normally positioned and struck, and to position the target more than a foot off the ground. This is something that would not be conducive to learning the swing if it were done merely with conventional clubs and balls. Since they must swing and strike a target so positioned, they retain the professional angle in the swing thru what would be the normal impact area instead of dissipating it when they use their clubs and balls in a normal position.

A golf professional's hands arrive ahead of the clubhead at impact and we have found that amateur golfers prematurely release the golf club anywhere from a few inches to a few feet before contacting the ball. This is exhibited by the amateur golfer's clubhead arriving at impact with the ball with their hands lagging behind said clubhead at impact. When the object of the strike is positioned on the Peripheral Stand, it automatically makes them hold the angle thru where normal impact would be.

So they actually perform the correct movement of having their hands arrive at the ball impact position before the clubhead when using the Peripheral Target Stand Training system. It is the only device that lets the golfer actually perform the correct movement from the start of the downswing to the finish. Once the feel of the correct backswing and the correct downswing are accomplished and trained, then ball contact is more consistent with every stroke in golf, from chipping and pitching to the full swing.

It also enables the golfer to practice these movements without the stress of using a golf ball. And obviously, it would be quite dangerous to attempt these movements with a golf ball and normal club. There would be no telling where the ball might disperse in that case.

A removable device is also provided that attaches to the clubface of the golfer's own clubs that mates with the movable target positioned on the stand. It is composed of Velcro® hook and wetsuit material fastened to the golf club.

It should be apparent that this stand can be constructed in a variety of ways, the most favored in a bean bag style so that if contacted with a practice club, it would not hurt the golfer. This would involve a nylon denier type cover that could be stuffed with towels, newspapers or the like. For more stability, it could also have a rubber foam interior. The Peripheral Target Stand could also be constructed with flexible plastic or metal rods to give it more strength and flexibility. It could also be constructed of vinyl so that it could be blown up, or a combination of the above. It could also take the form of a loop with an open end that releasably holds the target to allow the club to pass thru the general area of where the stand would usually be.

It should also be apparent that this could help any game where a participant is involved with an implement used to strike a ball. It is also apparent that various sizes should be available to accommodate the difference in the bodies of men and women and children.

Other objects will become apparent as the specification proceeds.

REFERENCED NUMERALS IN DRAWING

Figure 1A:
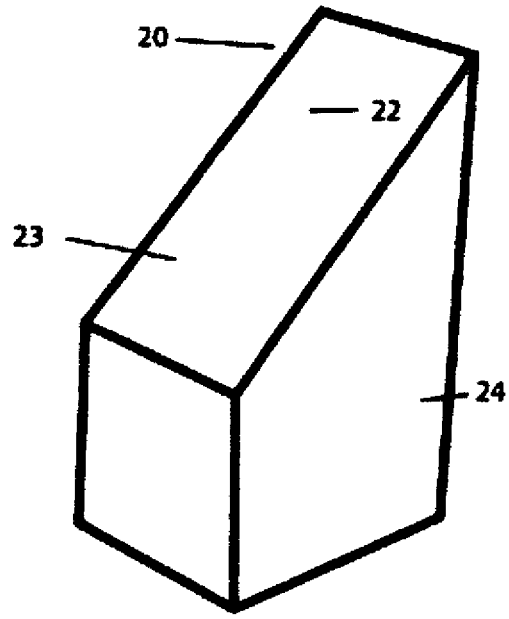
FIGS. 1A and 1B are perspective drawings of the stand part of the invention, showing the details of the nylon denier cover and the Velcro type material covering the upper part.
Figure 1B:
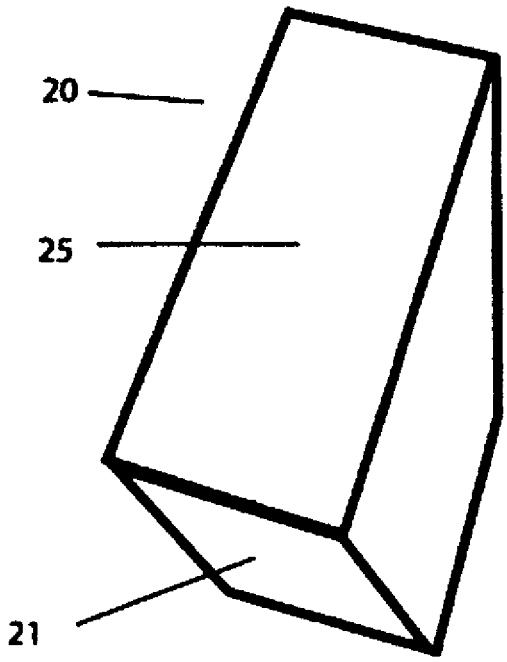

20 Peripheral Target Stand golf swing training device
21 First flat surface
22 Velcro type material on top of stand
23 Second surface
24 Denier Nylon cover of stand
25 Third flat surface
26 Movable Velcro Loop Target
28 Practice golf club
30 Golf club head
32 Golf club hook attachment
34 Line parallel to target line
36 Golf club hook velcro
38 Golf club face
40 Golfer
42 Target line
44 Practice golf club head

DETAILED DESCRIPTION OF THE PREFERRED EMBODIMENT

Reference will now be made in detail to the present preferred embodiment of the invention, an example of which is illustrated in the accompanying drawings in which like reference characters refer to corresponding elements.

With reference to FIGS. 1-7, the Peripheral Target Stand 20 apparatus of the present invention is illustrated. The apparatus is preferably used with a practice type golf club 28 or, alternately could be used with a regular golf club that has had a golf club hook attachment 32 affixed to it.

Figure 2:
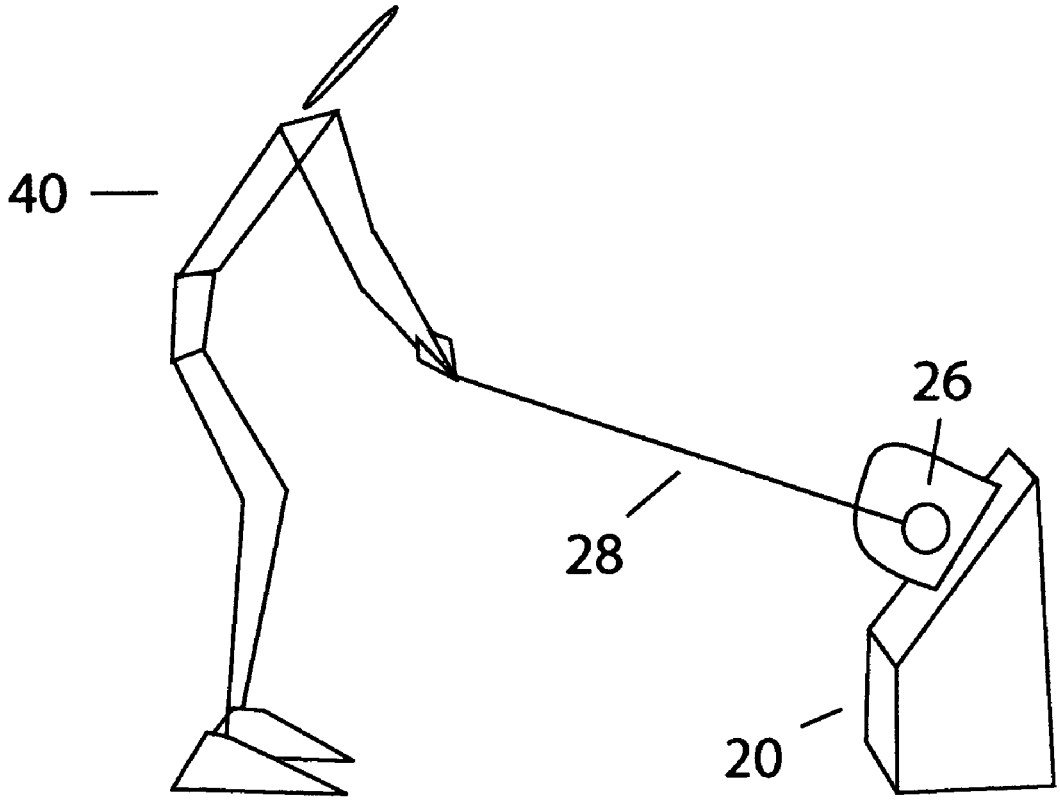
FIG. 2 is a view taken from behind the golfer at address with the present invention positioned where a normal ball would be positioned, but with the movable target positioned so that the golfer does not have to bend over to start learning the correct movements for a swing.
Figure 3:
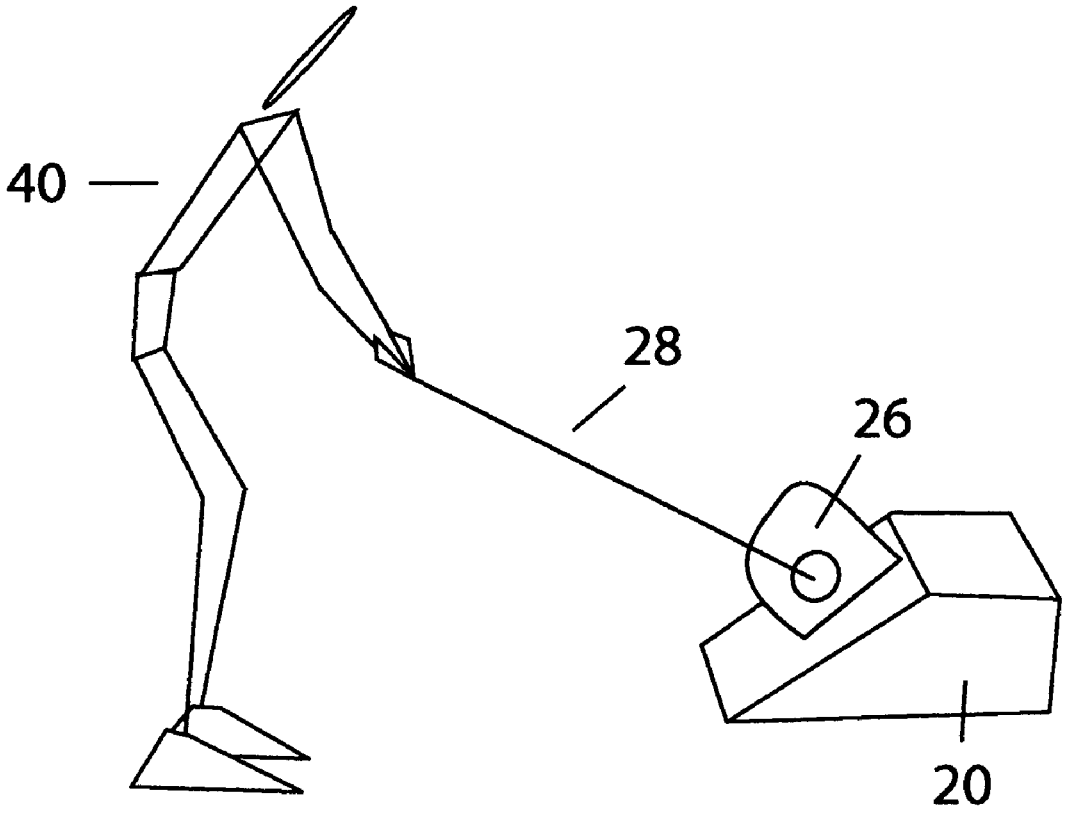
FIG. 3 is a view taken from behind the golfer at address with the present invention positioned where a normal ball would be positioned, but with the movable target positioned lower so that the golfer can incrementally learn the correct movements for a swing.
Figure 4:
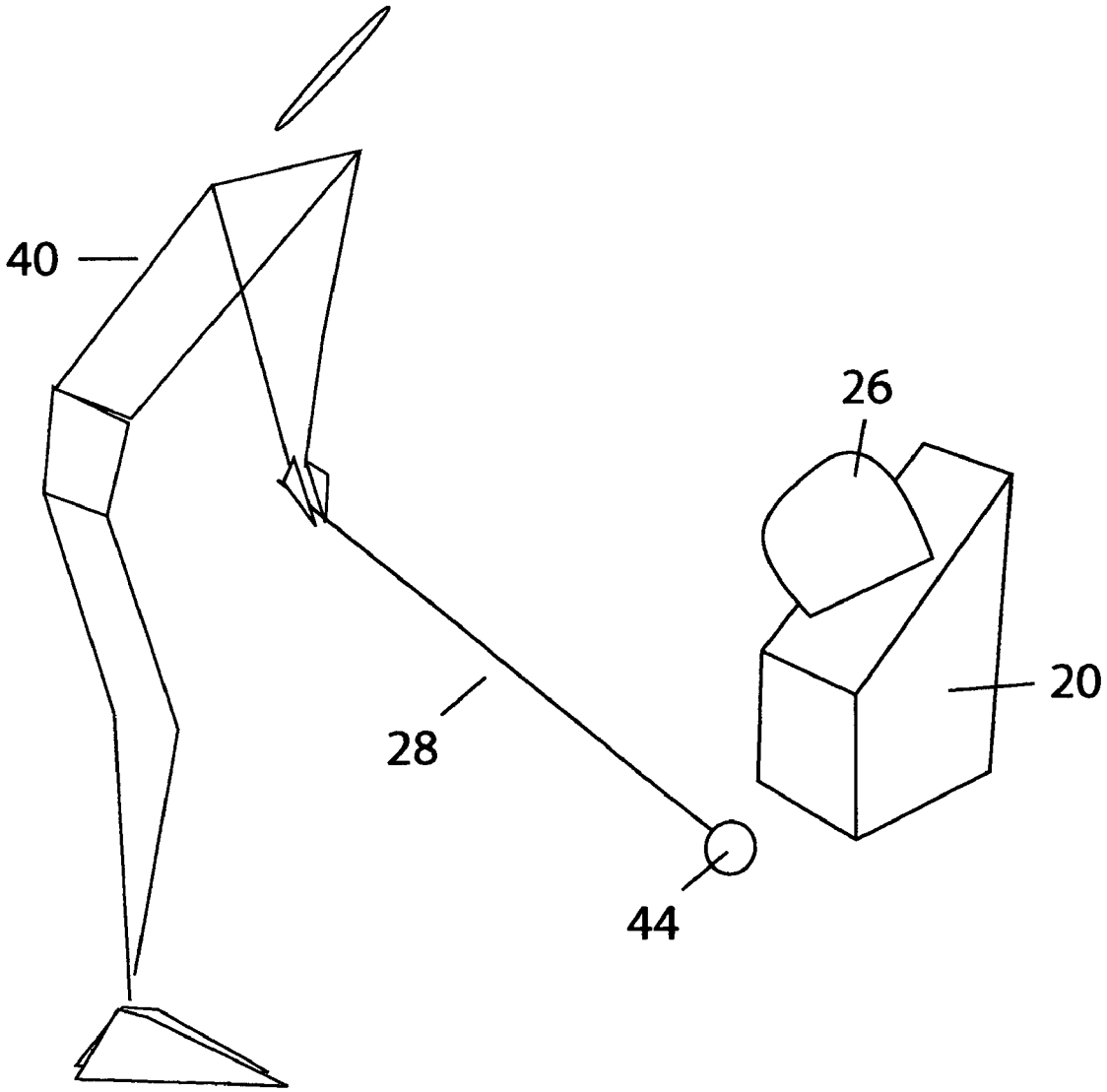
FIG. 4 is a view taken from behind the golfer at address with the present invention and the movable target positioned at a forty five degree angle from center and above the ground so that the golfer can learn the correct bodily movements for a correct backswing and a correct downswing.
Figure 5:
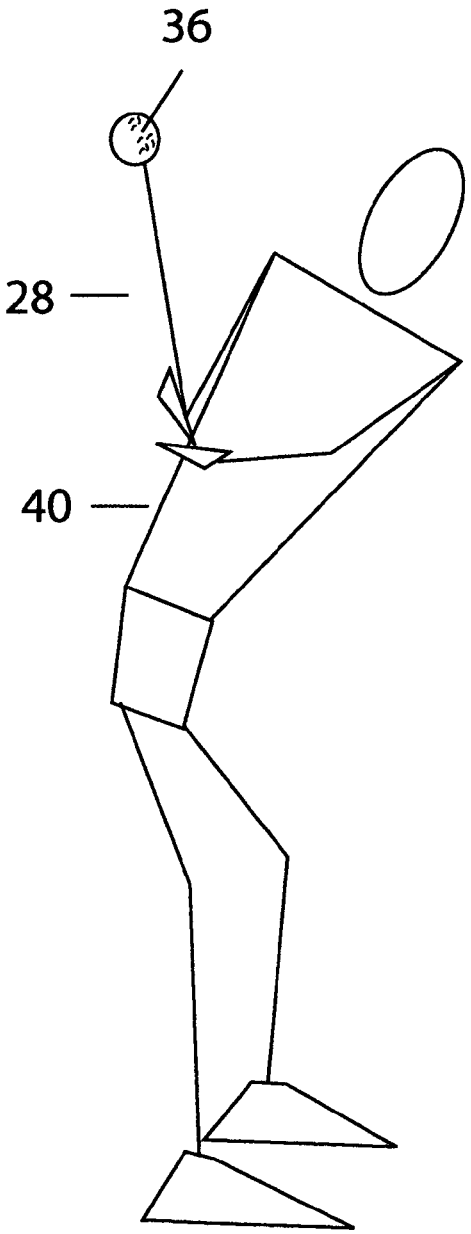
FIG. 5 is a view taken from behind the golfer at the top of his backswing, preparing to strike the movable target on the peripheral stand.
Figure 5:
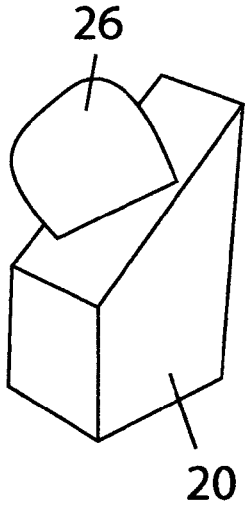
Figure 6:
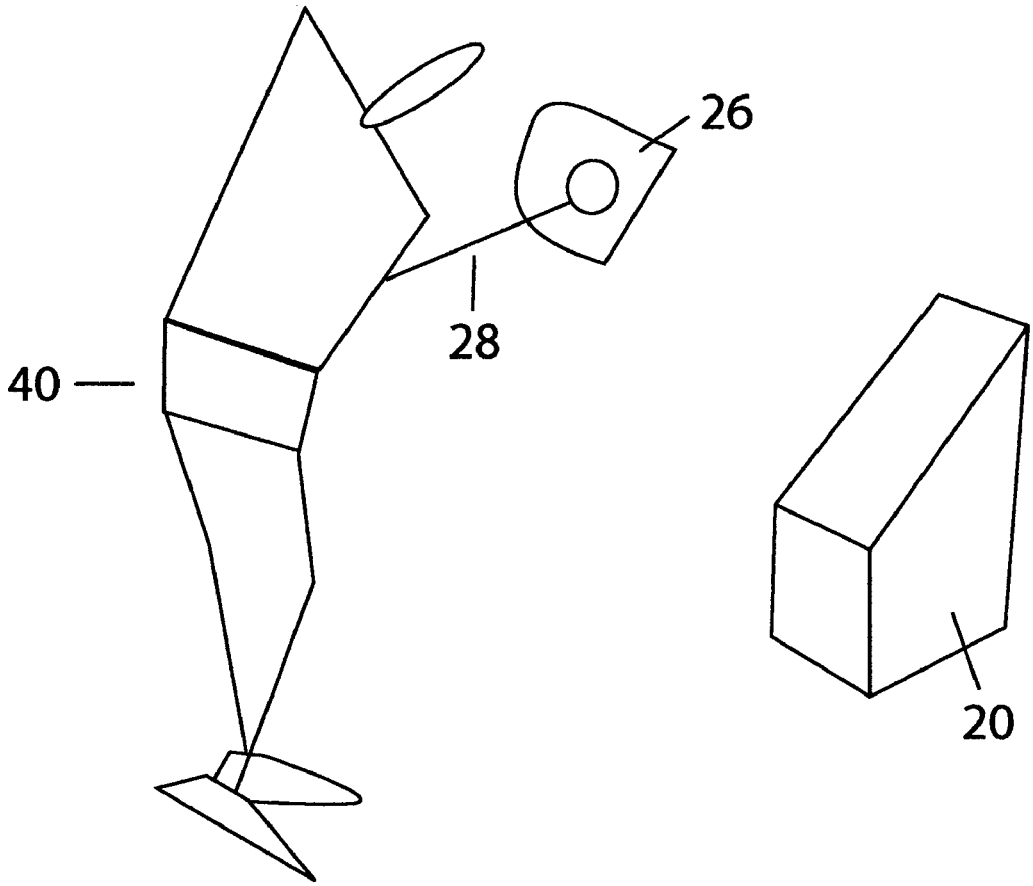
FIG. 6 is a view taken from behind the golfer after the correct impact, with his arms extended fully.
Figure 7:
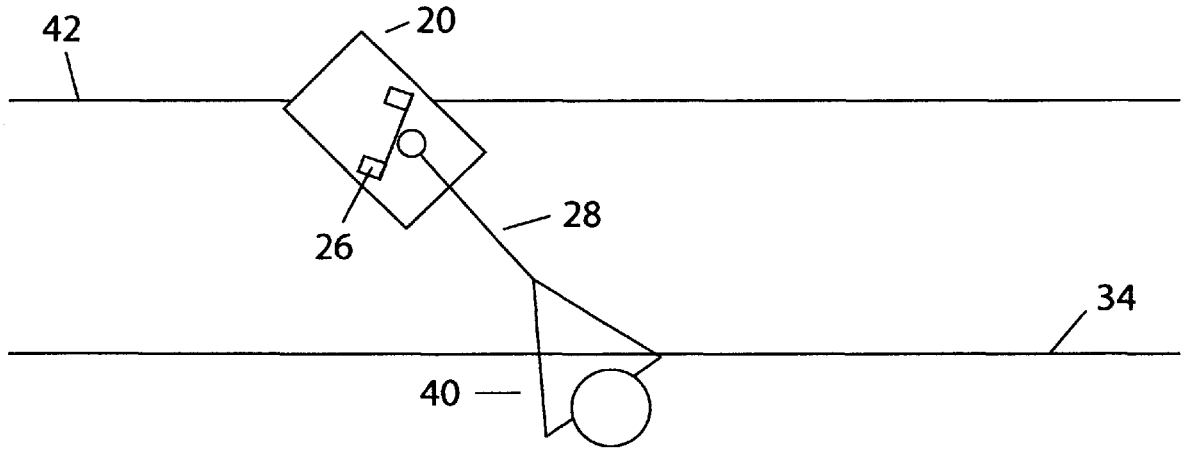
FIG. 7 is a view taken from above the golfer with the golf club at impact with the movable target positioned on top of the peripheral stand which is positioned at a forty five degree angle from where a golf ball would be normally positioned and struck.
Figure 8:
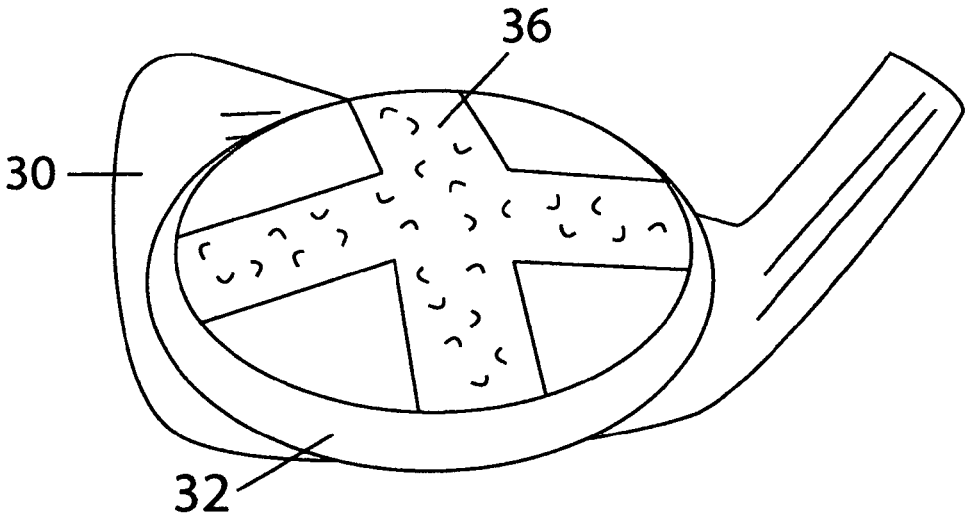
FIG. 8 is a perspective drawing of the clubhead attachment attached to the golf iron clubface.
Figure 9:
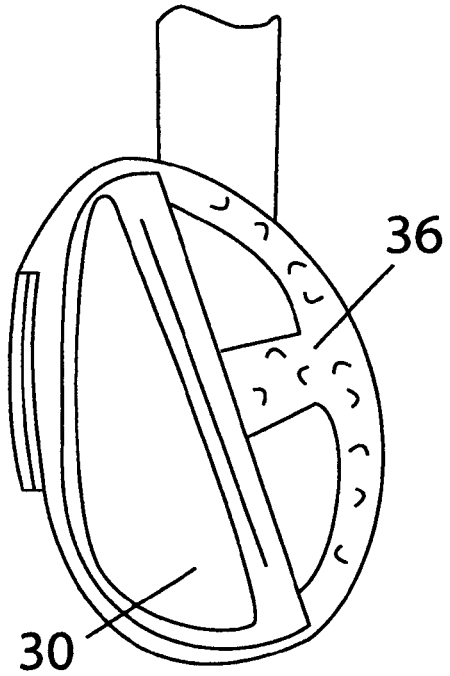
FIG. 9 is a side view of the clubhead attachment on an iron club face.
Figure 10:
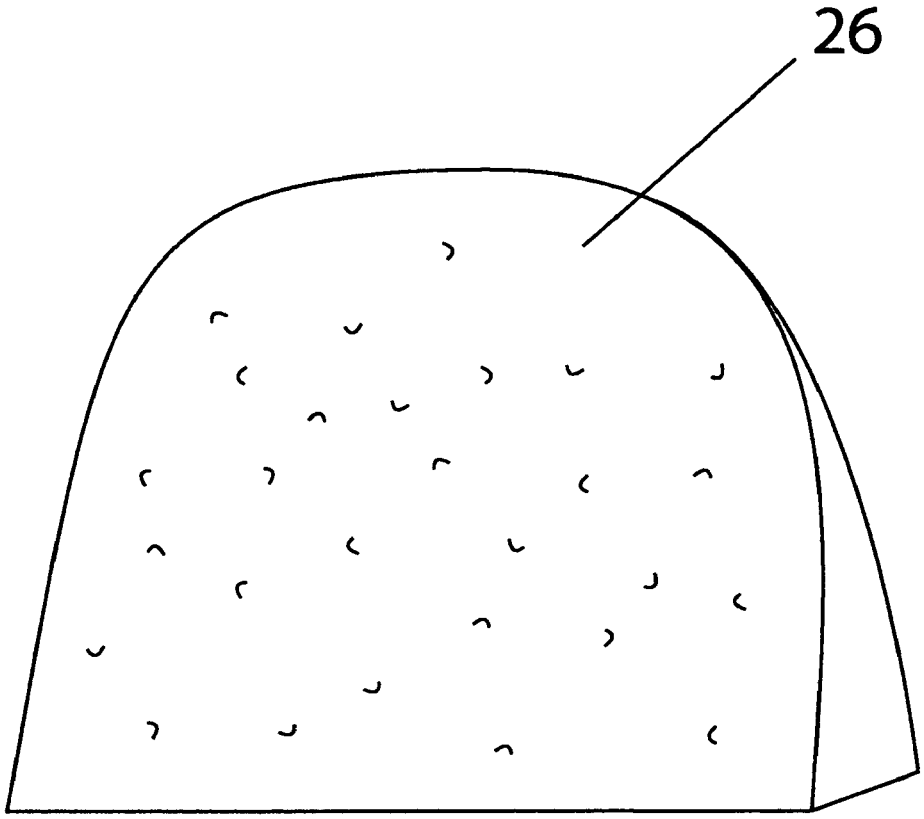
FIG. 10 is a perspective drawing of the movable striking target.

Practice with the training club 28 of the present invention is illustrated by the sequence of views of FIGS. 2-7. The movable target 26 is positioned as shown in FIG. 2, so that the golfer can start training in an upright position. He then goes thru a series of drills while moving the target 26 downward to the ground level where a ball would normally be located. He achieves this by positioning the peripheral golf stand 20 on its backside and rotating it one hundred and eighty degrees from its original position as shown in FIG. 3.

In addition, the Peripheral Target Stand 20 enables the golfer to exactly perform the correct length of backswing and also perform a professional type downswing, as shown in FIGS. 4-7. The Peripheral Target Stand 20 is positioned forwardly and equidistant from the golfer 40 at a forty five degree angle from the middle of his body and the target 26 is positioned more than a foot off the ground. The golfer 40 must not swing back any farther than he can return the practice club 28 to the movable target 26 stationed on the Peripheral Golf Stand 20 and be able to unite the mating Velcro materials. By doing this, the golfer 40 will learn the correct professional sequencing of his body and the club through impact. If he has not connected the mating Velcro materials on the target 26 and practice club 28, he has probably made a golf move commonly called "coming over the top" which Bobby Jones's teacher Stewart Maiden said in the 1920's was the fundamental cause of every bad shot in golf.

Thus we can see that this Peripheral Target Stand Training System 20 provides the golfer with unmistakable positive and negative feedback, as to the correct motions and muscular feelings that must be made in order for his body, including hands, wrists and forearms to be in the proper structure throughout the whole swing. This will allow inexperienced through scratch golfers to improve their ball striking abilities.

What is claimed is:

1. An apparatus for training a golfer to execute a golf swing, said apparatus comprising:

a stand comprising a substantially first flat surface, a second surface that is sloped or angled relative to said substantially flat first surface and a substantially flat third surface, said second surface being covered with a first hook and loop fastener layer;

a moveable target that is attachable to said second surface by means of a second hook and loop fastener layer, said movable target having a target surface to which is attached a third hook and loop fastener layer;

a golf club having a clubhead with a club face to which is attached a fourth hook and loop fastener layer that is attachable to said third hook and loop fastener layer.

2. The apparatus of claim 1 wherein said stand has a nylon cover and is filled with a yieldable material.

3. The apparatus of claim 1 wherein said fourth hook and loop fastener layer is not attachable to said second hook and loop fastener layer.

4. The apparatus of claim 1 wherein said stand comprises a structure having flexible plastic rods that support said second surface.

5. The apparatus of claim 1 wherein said stand is inflatable.

6. A method for training a golfer to execute a golf swing while standing on a practice surface, said method comprising:

positioning the apparatus of claim 1 in one of the following positions: in front of the golfer with said substantially flat first surface resting on the practice surface and said moveable target attached to said second surface, in front of the golfer with said substantially flat third surface resting on the practice surface and said moveable target attached to said second surface, or oriented 45 degrees counterclockwise from in front of the golfer with said substantially flat first surface resting on the practice surface and said moveable target attached to said second surface;

centering said clubhead on said moveable target;

cocking said golf club in a backswing;

swinging said golf club at said moveable target; and contacting said clubhead with said moveable target.

7. A method for training a golfer to execute a golf swing while standing on a practice surface, said method comprising:

providing the golfer with an apparatus comprising:

a stand comprising a substantially first flat surface, a second surface that is sloped or angled relative to said substantially flat first surface, a substantially flat third surface, and two fourth surfaces, said second surface being covered with a first hook and loop fastener layer, and a moveable target that is attachable to said second surface by means of a second hook and loop fastener layer, said movable target having a target surface to which is attached a third hook and loop fastener layer;

providing the golfer with a golf club having a clubhead with a club face to which is attached a fourth hook and loop fastener layer that is attachable to said third hook and loop fastener layer;

positioning said apparatus in one of the following positions: in front of the golfer with said substantially flat first surface resting on the practice surface and said moveable target attached to said second surface, in front of the golfer with said substantially flat third surface resting on the practice surface and said moveable target attached to said second surface, or oriented 45 degrees counterclockwise from in front of the golfer with said substantially flat first surface resting on the practice surface and said moveable target attached to said second surface;

centering said clubhead on said moveable target;

cocking said golf club in a backswing;

swinging said golf club at said moveable target; and contacting said golf club with said movable target.

8. A method for training a golfer to execute a golf swing while standing on a practice surface, said method comprising:

positioning a target having a target surface in a position, said target being releasable from said means for positioning and said position being selected from the group consisting of:

in front of the golfer with said target disposed more than one foot above the practice surface, in front of the golfer with said target disposed less than one foot above the practice surface, and oriented 45 degrees counterclockwise from in front of the golfer with said target disposed more than one foot above the practice surface;

centering a clubhead on said target without contacting said target with said clubhead, said clubhead being releasably attachable to said target;

cocking said golf club in a backswing;

swinging said golf club at said target; and contacting said clubhead with said target.

9. A system for training a golfer to execute a golf swing while standing on a practice surface, said system comprising:

means for adjustably positioning a target in a position, said target having a target surface to which a target surface hook and loop fastener layer is fixed, said target being releasable from said means for positioning and said position being selected from the group consisting of in front of the golfer with said target disposed more than one foot above the practice surface, in front of the golfer with said target disposed less than one foot above the practice surface, and oriented 45 degrees counterclockwise from in front of the golfer with said target disposed more than one foot above the practice surface; and means for contacting a clubhead with said target during a golf swing, thereby releasably attaching said target to said clubhead.

10. The system of claim 9 wherein said means for adjustably positioning has a nylon cover and is filled with a yieldable material.

11. The system of claim 9 wherein said means for positioning has a support surface with a support surface hook and loop fastener layer and said clubhead has a clubhead hook and loop fastener layer that is not attachable to said support surface hook and loop fastener layer.

12. The system of claim 11 wherein said means for positioning comprises a structure having flexible plastic rods that support said support surface.

13. The system of claim 11 wherein said means for positioning is inflatable.

14. The system of claim 11 wherein said means for positioning is inflatable.

15. A system for training a golfer to execute a golf swing with a club having a clubhead while standing on a practice surface, said system comprising:

a target;

means for adjustably positioning said target within the golfer's peripheral vision at a height above the practice surface that is selectable by the golfer, said target comprising a target surface having a loop fastener layer; and means for contacting said clubhead with said target during a golf swing, said clubhead having a club face that is provided with a club face hook fastener layer that is capable of releasably attaching said target to said clubhead;

wherein said means for adjustably positioning has a nylon cover and is filled with a yieldable material.

16. The system of claim 15 wherein said means for adjustably positioning has a nylon cover and is filled with a yieldable material.

17. The system of claim 15 wherein said means for positioning has a support surface with a support surface hook fastener layer and said club face has a club face hook fastener layer that is not attachable to said support surface hook fastener layer.

18. The system of claim 17 wherein said means for positioning comprises a structure having flexible plastic rods that support said support surface.

19. A method for training a golfer to execute a golf swing while standing on a practice surface, said method comprising:

adjustably positioning a target within the golfer's peripheral vision at a selectable height above the practice surface with a means for adjustably positioning that has a nylon cover and is filled with a yieldable material, said target comprising a target surface having a loop fastener layer; and contacting a clubhead with said target during a golf swing, said clubhead having a club face that is provided with a hook fastener layer;

thereby releasably attaching said target to said clubhead.

20. A method for training a golfer to execute a golf swing while standing on a practice surface, said method comprising:

a step for adjustably positioning a target within the golfer's peripheral vision at a selectable height above the practice surface with a means for adjustably positioning that has a nylon cover and is filled with a yieldable material, said target comprising a target surface having a loop fastener layer; and a step for contacting a clubhead with said target during a golf swing, said clubhead having a club face that is provided with a hook fastener layer;

thereby releasably attaching said target to said clubhead.

* * * * *